United States Patent [19]

Ambardanishvili et al.

[11] 4,016,095

[45] Apr. 5, 1977

[54] SOURCE OF IONIZING RADIATION

[76] Inventors: Tristan Silovanovich Ambardanishvili, territoriya ippodroma, korpus 4, kv. 38; Vakhtang Justinovich Dundua, territoriya ippodroma, korpus 4, kv. 25; Mikhail Alexandrovich Kolomiitsev, ulitsa Ozhio, 7, all of Tbilisi, U.S.S.R.

[22] Filed: May 1, 1973

[21] Appl. No.: 356,194

[52] U.S. Cl. ..... 252/301.1 R; 250/493; 250/496

[51] Int. Cl.[2] ..... G21G 4/00

[58] Field of Search ..... 252/301.1 R; 250/493, 250/496

[56] References Cited

UNITED STATES PATENTS

| | | | |
|---|---|---|---|
| 2,559,259 | 7/1951 | Raper | 252/301.1 R |
| 2,973,292 | 2/1961 | Yanko et al. | 252/301.1 R |
| 3,133,025 | 5/1964 | Walker et al. | 252/301.1 R |

FOREIGN PATENTS OR APPLICATIONS

| | | | |
|---|---|---|---|
| 1,186,534 | 4/1970 | United Kingdom | 252/301.1 R |

*Primary Examiner*—Richard E. Schafer

[57] ABSTRACT

An ionizing radiation source comprising a molded and hardened composition based on a phenol-formaldehyde resin and a radioactive material molecularly or ionically dispersed in the resin.

11 Claims, 3 Drawing Figures

Figures 1, 2:
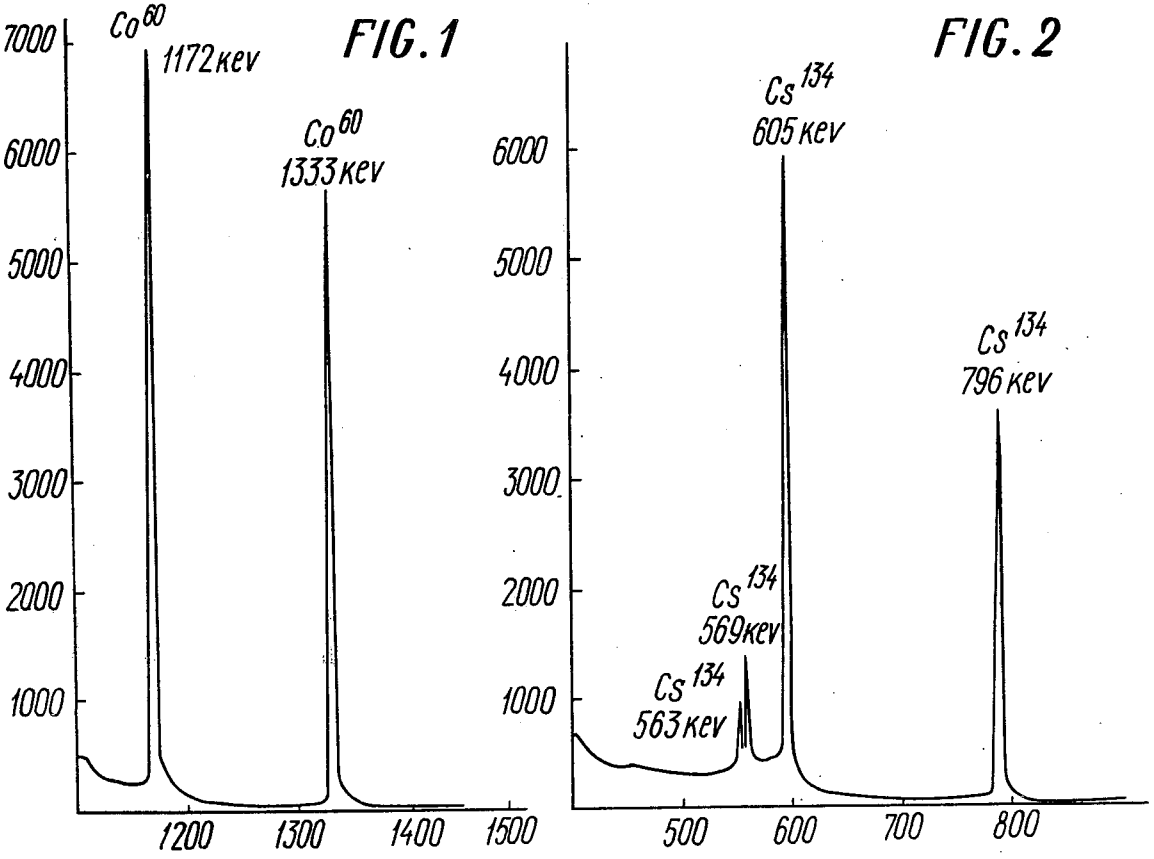

Co60
1172 kev
Co60
1333 kev
7000
6000
5000
4000
3000
2000
1000
1200
1300
1400
1500

Cs134
605 kev
Cs134
569 kev
Cs134
563 kev
Cs134
796 kev
6000
5000
4000
3000
2000
1000
500
600
700
800

SOURCE OF IONIZING RADIATION

This invention relates to nuclear physics and, more particularly, to an ionizing radiation source intended primarily for the calibration of multichannel gamma-radiation analyzers.

Ionizing radiation sources are currently available which consist of a radioactive material deposited onto a non-radioactive material substrate such as, for example, polyethylene film. After deposition of the radioactive material onto the film, the radiation source thus obtained is sealed by coating the radioactive material with another polyethylene film and the resulting structure is placed in an appropriate holder.

These prior art sandwiched sources suffer from the disadvantages of having inadequate strength and of having the radioactive material non-uniformly distributed over the cross-sectional area of the source. The latter limitation stems from the method of radiation source production which involves the evaporation of aqueous or aqueous alcoholic solutions of radioactive materials.

This-method is further disadvantageous in that it provides no possibility of producing a large number of radiation sources having the same amounts of radioactive material, so that in the case of sandwiched radiation sources each source should be subjected to a laborious calibration procedure to establish its activity.

Ionizing radiation sources are also available comprising a radioactive material distributed in the mass of a non-radioactive material, viz., aluminum, said sources being noted for their high mechanical strength and for uniform radioactive material distribution through out the mass.

However, aluminum-base radiation sources are disadvantageous in that aluminum is a relatively strong absorber of gamma quanta in the 0 to 300 keV range.

Moreover, the method of manufacturing such aluminum-base sources which comprises alloying aluminum with a radioactive material makes it possible to obtain sources with but a limited number of radioactive metals such as, for example, cobalt-60, manganese-54 and zinc-65.

Among currently available ionizing radiation sources mention should also be made of polymer-base sources comprising a mixture of a radioactive material with an epoxide resin, the radioactive materials used being metal oxides.

Said polymer-base sources suffer from the drawback of having the radioactive material non-uniformly distributed over the cross-sectional area of a source, said drawback being particularly pronounced where the content of the radioactive material is less than $10^{-3}$ g per gram of the epoxide resin used and excluding the possibility of producing sources of an identical specific activity expressed in radioactive decay events per gram per second.

Each ionizing radiation source of this type requires laborious individual calibration to determine its activity.

When this type of source is employed as a standard for the calibration of relevant instruments, the aforementioned disadvantages are the cause of additional errors.

The ionizing radiation sources of all prior art types described hereinbefore have an essential limitation as far as the employment of said sources for calibrating gamma-spectrometers furnished with high-resolution detectors (about 0.5 to 5.0 keV), since said sources invariably contain one radioactive isotope as the radioactive material, thereby rendering the measurements involved in the calibration procedure excessively laborious and protracted.

It is an object of the present invention to provide an ionizing radiation source, in which the radioactive material consists of any desired desired combination of gamma-emitting isotopes and the distribution of said isotopes over the cross-sectional area and throughout the mass of the source is uniform.

In accordance with this and other objects, there is provided an ionizing radiation source comprising a moulded and hardened composition prepared from a resin and a radioactive material dispersed in said resin wherein, according to the invention, the resin component of said composition is a phenolaldehyde resin containing ionically or molecularly dispersed particles of said radioactive material.

More particularly, the present invention contemplates the use of the resol type of phenol-formaldehyde resin component of the composition.

A preferred embodiment of this invention contemplates the use of the novolak type of phenol-formaldehyde resin mixed with hexamethylenetetramine as the resin component of the composition.

A further preferred embodiment of this invention contemplates the use of the resol type of resorcinol-formaldehyde resin as the resin component of the composition.

Another preferred embodiment of this invention is to use a mixture of 70–80 parts by weight of the resol type of phenol-formaldehyde resin and 10–30 parts by weight of the novolak type of phenol-benzaldehyde resin as the resin component of the composition.

This invention contemplates using a mixture of spectrally pure gamma-emitting isotopes as the radioactive material ionically or molecularly dispersed in the composition.

Figure 3:
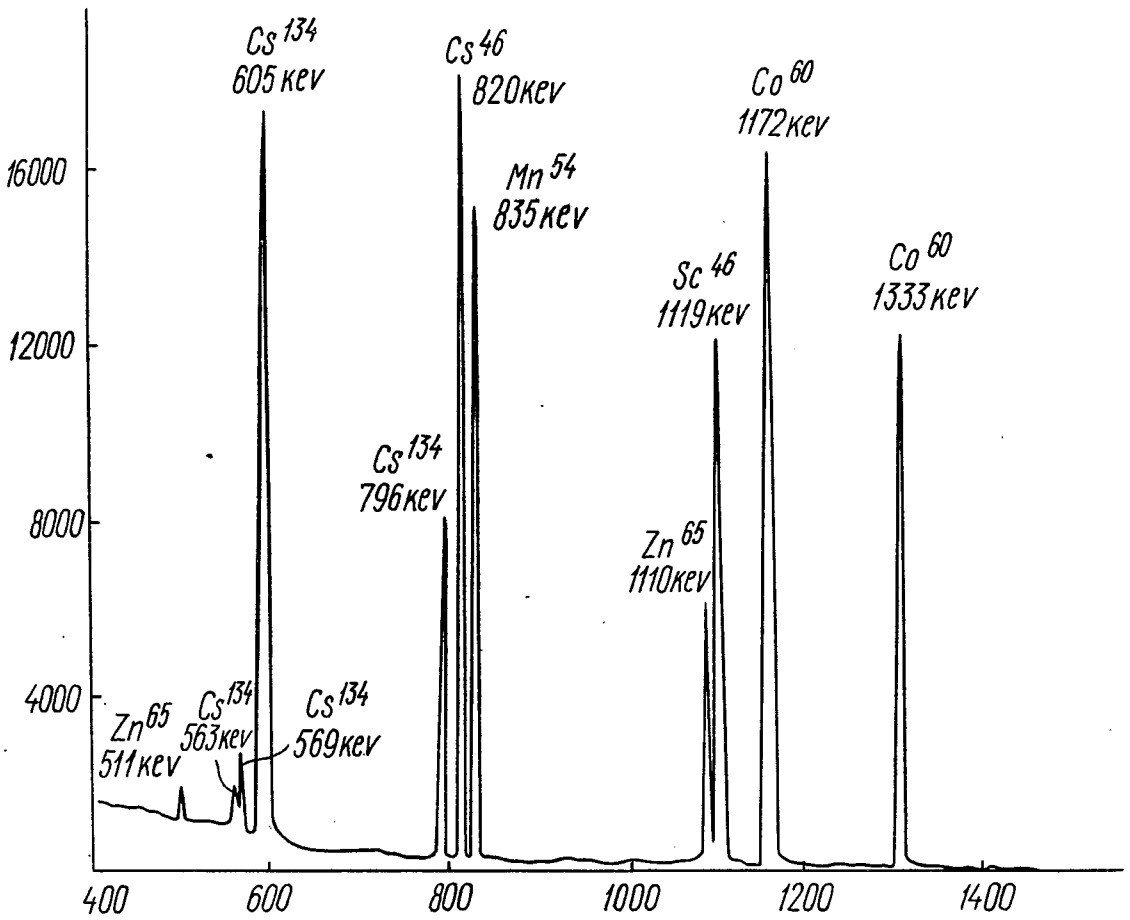

Other objects and advantages of the present invention will be apparent from the consideration of exemplary embodiments thereof taken in conjunction with the accompanying drawings, wherein FIG. 1 graphically shows the gamma spectrum of cobalt-60 in which the source activity is expressed in pulses per minute and is plotted on the ordinate and the number of gamma-spectrometer channels is plotted on the abscissa;

FIG. 2 graphically shows the gamma spectrum of cesium-134, in which the source activity is expressed in pulses per minute and is plotted on the ordinate and the number of gamma-spectrometer channels is plotted on the abscissa;

FIG. 3 graphically shows the gamma spectrum of a source containing a plurality of isotopes, in which the source activity is expressed in pulses per minute and is plotted on the ordinate and the number of gamma-spectrometer channels is plotted on the abscissa.

An ionizing radiation source, in which the radioactive material consists of any desired combination of radioactive isotopes, can be based on phenol-aldehyde resins such as, for example, resol-type phenol-formaldehyde resin, resol-type resorcinol-formaldehyde resin, a mixture of said resol resins with novolak-type phenol-benzaldehyde resin, etc., so that said ionizing radiation source comprises a moulded and hardened composition based on a phenol-aldehyde resin and a radioactive material ionically or molecularly dispersed in said resin.

The resins listed above are noted for their high mechanical strength, glass-like state, ability to react with ions of diverse elements, and low specific weight, said properties of said resins being retained in the ionizing radiation sources manufactured from the resins in question.

Hence, the ionizing radiation sources, according to the invention, exhibit high mechanical strength and require no additional sealing on account of their glass-like state.

Chemical bond formation between radioactive elements and they hydroxyl groups of the resin used provides for the uniform distribution of the radioactive isotopes throughout the mass of the source, inasmuch as the resin-isotopes mixture is a solid molecular solution, the radioactive material particles being ionically or molecularly dispersed and forming no thermodynamic phase of their own.

In fact sources, isotope distribution over the cross-sectional area is uniform due to the formation of true, i.e. ionic or molecular solutions of radioactive isotope ions in the resin.

The composition, from which the present source is made, consists essentially of light elements, such as carbon, hydrogen and oxygen, the specific gravity of said resin being low, viz, from 1.1 to 1.3 g/cm$^3$, so that radiation self-absorption in the source will be insignificant. Thus, in case the ionizing radiation source contains isotopes that emit gamma quanta having a minimum energy of 200 keV, the coefficient of self-absorption in a source about 1 mm thick amounts to less than 0.1–2% and can, therefore, be disregarded. Where ionizing radiation sources incorporate beta-emitting isotopes, the magnitude of self-absorption inherent in a given source is determined for each specific energy of beta particles by conventional techniques.

The following Examples describe by way of illustration the procedures employed for the preparation of selected ionizing radiation sources.

EXAMPLE 1

The ionizing radiation source is a solid molecular solution of radioactive isotopes Mn-54, Fe-59 and P-39 in the result type phenol-formaldehyde resin.

The procedure comprises irradiating iron sulphate in a neutron field of a nuclear reactor with a fast neutron integral flux of about $10^{18}$ neutrons per sq. cm., followed by adding to 1 g. of the irradiated iron sulphate 10 mg. of manganese sulphate and 1 mg. of sodium dihydrogen phosphate. The resulting mixture is dissolved in 100 ml. of 96% ethanol, and the solution is introduced into a flask containing 200 ml. of a 50% solution of resol-type phenol-formaldehyde resin in ethanol. Both solutions are mixed and the ethanol is thereafter distilled off in vacuo (ca. 50 mm of Hg) at a temperature of about 60° C on a water bath, followed by raising the temperature to 90° C and maintaining it for a period of 15 to 20 minutes to remove the water.

The thus-obtained syrup-like mass is placed in a vacuum thermostat and maintained under a vacuum of about 50 mm of Hg and at a temperature of about 80° C for 2 to 3 hours to yield a porous mass which is cooled to room temperature and ground to powder. The powder is tabletted under a pressure of from 250 to 1,000 kg/cm$^2$ and the resulting tablets 10 mm. in dia. and 1 mm. thick are heated at 80° C for 5 to 10 hours, the temperature being subsequently raised to 100°–150° C and maintained for a period of from 2 to 5 hours to ultimately cure the composition.

The ionizing radiation sources obtained by the aforedescribed procedure are noted for their high mechanical strength and find application for the calibration of gamma spectrometers with respect to the energy of gamma quanta emitted by Mn-54 and Fe-59 and also of $\beta$-particles emitted by P-32.

EXAMPLE 2

The ionizing radiation source comprises a solid molecular solution of Co-60 in resol-type phenol-formaldehyde resin.

Shown in FIG. 1 is the gamma spectrum of such a source taken on a multichannel analyzer having a semiconductor-type Ge(Li) detector (volume, 25 cm$^3$). As can be seen from the spectrum, the source contains a pure isotope since the spectrum is free from gamma peaks due to impurities. The source can be used conveniently for gamma spectrometer calibration with respect to the energies of about 1,170 and 1,333 keV.

The procedure of preparing said gamma emitting source comprises dissolving 0.5 g of cobalt nitrate that contains radioactive isotope Co-60 and has an overall activity of 100 microcurie (mcC) in 50 ml. of 96% ethyl alcohol. Next the cobalt nitrate solution is introduced into a flask containing 200 ml. of a 50% solution of resol-type phenol-formaldehyde resin in ethyl alcohol, and the resulting mixture is processed as described in Example 1.

The ionizing radiation sources thus prepared are tablets 10 mm. in dia. and 1 mm thick, the activity of each source being about 0.1 mcC.

EXAMPLE 3

The ionizing radiation source, which consists of resorcinol-formaldehyde resin with radioactive isotope Cs-134 uniformly distributed therein, is prepared in accordance with the following procedure.

One gram of cesium nitrate (overall activity, 100–500 mcC) is dissolved in 100–150 ml. of 96% ethyl alcohol, and the solution is introduced into a flask containing 200 ml. of a 50% solution of resol-type resorcinol-formaldehyde resin in ethyl alcohol, and the mixture is stirred.

Next the ethyl alcohol is stripped from the mixture by placing the flask on the water bath and heating the contents are heated under vacuum (10–50 mm of Hg) at a temperature of about 60° C, followed by raising the temperature to 90° C and distilling off the water for a period of 15 to 20 min. The resulting syrup-like mass is next poured into dishes made of polytetrafluoroethylene and maintained in a thermostat at a temperature of from 80° to 100° C for a period of 24–48 hours to cause composition hardening.

When use is made of dishes 10 mm in dia and 5 mm high, 1 kg of the resin is adequate for the manufacture of about 1,000 to 1,500 ionizing radiation sources, provided production losses are accounted for.

FIG. 2 shows the gamma spectrum of the Cs-134 source plotted by means of a multichannel analyzer having a 25 cm$^3$ Ge (Li) detector. As can be seen from the graph, the source contains one radioactive isotope only.

EXAMPLE 4

The ionizing radiation source comprises a solid molecular solution of Cs-134, Mn-54, Sc-46, Zn-65 and Co-60 in resol-type phenol-formaldehyde resin modified with 20% of novolak-type phenol-formaldehyde resin modified with 20% of novolak-type phenol-benzaldehyde resin.

The energy of the photopeaks and the absolute activity of each isotope in the source are listed in Table 1.

Table 1

| Isotope | Activity, microcurie | Energy of principal photopeaks, keV | |
|---|---|---|---|
| | | $E\gamma_1$ | $E\gamma_2$ |
| Cs-134 | 0.15 | 604 | 796 |
| Mn-54 | 0.25 | 835 | — |
| Sc-46 | 0.30 | 890 | 1,119 |
| Zn-65 | 0.30 | 1,110 | — |
| Co-60 | 0.40 | 1,172 | 1,333 |

The following procedure is employed for the manufacture of this type of source.

The isotopes listed above are taken in the form of nitrates containing respective non-radioactive isotopes, and the mixture is prepared from 0.4g of each salt, the activity of each salt being selected to be as follows: Co-60, 60–80 mcC; Zn-65, 60 mcC; Sc-46, 60 mcC; Mn-54, 50 mcC, and Cs-134, 30 mcC. The mixture is dissolved in 100 ml. of 96% ethyl alcohol.

Next 20 g of phenol-benzaldehyde novolak and 80 g of resol-type phenol-formaldehyde resin are placed in a flask, 100 ml. of 96% ethyl alcohol is added thereto, the mixture is stirred until the resins undergo complete dissolution, and then the previously prepared alcoholic solution of the mixture of radioactive metal nitrates is introduced into the flask.

Stripping the alcohol and water from the contents of the flask is conducted as described in Examples 1 or 3.

The resulting syrup-like mass is poured, in 0.5-gram batches, into polytetrafluoroethylene dishes 15 mm in dia. which are placed in a thermostat and maintained at a temperature of 100° C for a period of from 48 to 72 hours.

The procedure described hereinabove yields ionizing radiation sources noted for their identical content of radioactive isotopes which corresponds to the composition listed in Table 1.

The gamma spectrum of this type of source is shown in FIG. 3. As can be seen, the resolving power of the Ge(Li) detector used in adequate for discriminating all the photopeaks, so that measurements involving the use of one such source only provide data which is sufficient for the energy calibration of multichannel analyzers.

EXAMPLE 5

The ionizing radiation source comprises a composition based on phenol-formaldehyde novolak cured by means of hexamethylenetetramine and containing radioactive isotope Mn-54 distributed therein.

To prepare this type of source, use is made of the following procedure. To 5 ml. of an aqueous solution of manganese sulphate containing only the Mn-54 isotope and no inactive carrier and having the total activity ov 100 mcC there is added 100 ml. of 96% ethyl alcohol, and the mixture is stirred, followed by introducing said solution into 200 ml. of a 50% solution of phenol-formaldehyde novolak in ethyl alcohol, and thereafter adding to the mixture 100 ml. of the solution obtained by dissolving 10 g hexamethylenetetramine in ethyl alcohol. Next the mixture is thoroughly mixed and thereafter processed in accordance with the procedure disclosed in Example 1.

The resulting gamma radiation sources have an activity of about 0.1 mcC. In all sources of a given lot, the specific activity of the composition, from which the sources are made, is constant to within 0.5%.

EXAMPLE 6

The ionizing radiation source comprises a hardened composition obtained from 60% of resol-type phenol-formaldehyde resin and 40% of novolak-type phenol-formaldehyde resin and having Co-58 distributed therein.

This type of source is prepared by the following procedure. To 10 ml. of an aqueous solution of cobalt-58 acetate having a total activity of 500 mcC, there is added of 0.5 ml. of an aqueous solution of non-radioactive cobalt acetate (concentration, $10^{-6}$g/ml.) and also 100 ml. of 96% ethyl alcohol, followed by stirring the resulting solution and transferring it into a flask that contains 200 ml. of a solution of 60 g of resol-type phenol-formaldehyde resin and 40 g of novolak-type phenol-formaldehyde resin in ethyl alcohol. The mixture is throughly stirred and thereafter processed following the procedure of Example 4.

The activity of the resulting gamma radiation sources equals 0.5 microcurie, and in all sources of a given lot, the specific activity of the composition, from which the sources are made is constant to within 0.5%.

In all instances where the desired ionizing radiation sources are produced by dispersing appropriate radioactive isotope salts in phenol-aldehyde resins, there occurs the formation of true solid solutions of said isotopes throughout the entire resin bulk, thereby making it possible to readily obtain a large number of sources having an absolutely identical specific content of a given radioactive isotope.

About 5,000 to 7,000 ionizing radiation sources in the form of tablets about 10 mm in dia and 1 mm thick can be manufactured from 1 kg of the phenolic resin, the radioactive standardization of the sources being substantially simplified by the fact that it is sufficient to determine the specific activity of from 3 to 10 sources, while the activity of all other sources can be obtained with a high degree of accuracy by weighing precisely each source and making simple calculations to estimate the activity.

The ionizing radiation sources, according to the invention, which contain several radioactive isotopes are eminently suited for calibrating multichannel gamma spectrometers furnished with semiconductor detectors of a high resolving power of about 0.5 to 5 keV.

The availability of ionizing radiation sources that contain a plurality of gamma-emitting isotopes provides the possibility of rendering the procedure of calibrating multichannel gamma analyzers less laborious and of enhancing the accuracy of measurements.

What we claim is:

1. An ionizing radiation source comprising a moulded and hardened composition based on a phenol-aldehyde resin and a radioactive material uniformly distributed in said resin, said radioactive material forming a chemical bond with the hydroxyl groups of the phenol-aldehyde resin to form a uniform distribution of the radioactive material throughout said resin, said radioactive material forming a solid molecular solution in said resin so as to be ionically and molecularly dispersed in said resin without formation of its own thermodynamic phase.

2. An ionizing radiation source as claimed in claim 1 wherein the phenol-aldehyde resin is a resol-type phenol-formaldehyde resin.

3. An ionizing radiation source as claimed in claim 1 wherein the phenol-aldehyde resin is novolak-type phenol-formaldehyde resin admixed with hexamethylenetetramie.

4. An ionizing radiation source as claimed in claim 1 wherein the phenol-aldehyde resin is a resol-type resorcinol-formaldehyde resin.

5. An ionizing radiation source as claimed in claim 1 wherein the phenol aldehyde resin is a mixture of 70 to 90 parts by weight of a resol-type phenol-formaldehyde resin and 10–30 parts by weight of a novolak-type phenol aldehyde resin.

6. An ionizing radiation source as claimed in claim 1 wherein the radioactive material is a mixture of spectrally pure gamma-emitting isotopes.

7. An ionizing radiation source as claimed in claim 2 wherein the radioactive material is a mixture of spectrally pure gamma-emitting isotopes.

8. An ionizing radiation source as claimed in claim 3 wherein the radioactive material is a mixture of spectrally pure gamma-emitting isotopes.

9. An ionizing radiation source as claimed in claim 4 wherein the radioactive material is a mixture of spectrally pure gamma-emitting isotopes.

10. An ionizing radiation source as claimed in claim 5 wherein the radioactive material is a mixture of spectrally pure gamma-emitting isotopes.

11. An ionizing radiation source as claimed in claim 1 wherein the radioactive material is metallic.

* * * * *